US011781304B2

(12) United States Patent
Webb et al.

(10) Patent No.: US 11,781,304 B2
(45) Date of Patent: Oct. 10, 2023

(54) TOILET FOR USE WHILE SQUATTING OR SITTING

(71) Applicant: Project No. 2 Limited, London (GB)

(72) Inventors: Ian Webb, London (GB); Andre De Koning, The Hague (NL)

(73) Assignee: PROJECT NO. 2 LIMITED, London (GB)

( * ) Notice: Subject to any disclaimer, the term of this patent is extended or adjusted under 35 U.S.C. 154(b) by 0 days.

(21) Appl. No.: 16/466,882

(22) PCT Filed: Dec. 1, 2017

(86) PCT No.: PCT/GB2017/053634
§ 371 (c)(1),
(2) Date: Jun. 5, 2019

(87) PCT Pub. No.: WO2018/104709
PCT Pub. Date: Jun. 14, 2018

(65) Prior Publication Data

US 2020/0063424 A1 Feb. 27, 2020

(30) Foreign Application Priority Data

Dec. 6, 2016 (GB) ..... 1620742

(51) Int. Cl.
*E03D 11/04* (2006.01)

(52) U.S. Cl.
CPC ..... *E03D 11/04* (2013.01)

(58) Field of Classification Search
CPC ..... E03D 11/02; E03D 11/04; E03D 11/13; E03D 9/08; A47K 13/10; A47K 13/105; A47K 13/02
See application file for complete search history.

(56) References Cited

U.S. PATENT DOCUMENTS 751,270 A 2/1904 Arvid
912,754 A * 2/1909 Stover ..... E03D 11/02 4/421

(Continued)

FOREIGN PATENT DOCUMENTS

CN 2506716 Y 8/2002
CN 2729176 Y 9/2005

(Continued)

*Primary Examiner* — Erin Deery
(74) *Attorney, Agent, or Firm* — FisherBroyles, LLP; Jason P. Mueller

(57) ABSTRACT

This disclosure relates to a toilet and components thereof, including a toilet bowl, a toilet seat, a toilet lid, and flushing apparatus. Also described are methods for manufacturing such toilets and components, and materials suitable therefore. A disclosed toilet may be used in a squatting posture and includes toilet a bowl including a flat base for contacting a floor, the base including an outlet, the flat base defining a plane that includes a forward direction and a transverse direction perpendicular to the forward direction. The toilet bowl is shaped to define a rearward portion including the base and an elongate frontal extension for a user to straddle, the frontal extension extending generally in the forward direction from the rearward portion; and at least some of the frontal extension is elevated or inclined relative to the base to provide a clearance between the toilet bowl and the floor.

28 Claims, 10 Drawing Sheets

(56) References Cited

U.S. PATENT DOCUMENTS

Figure 1A:
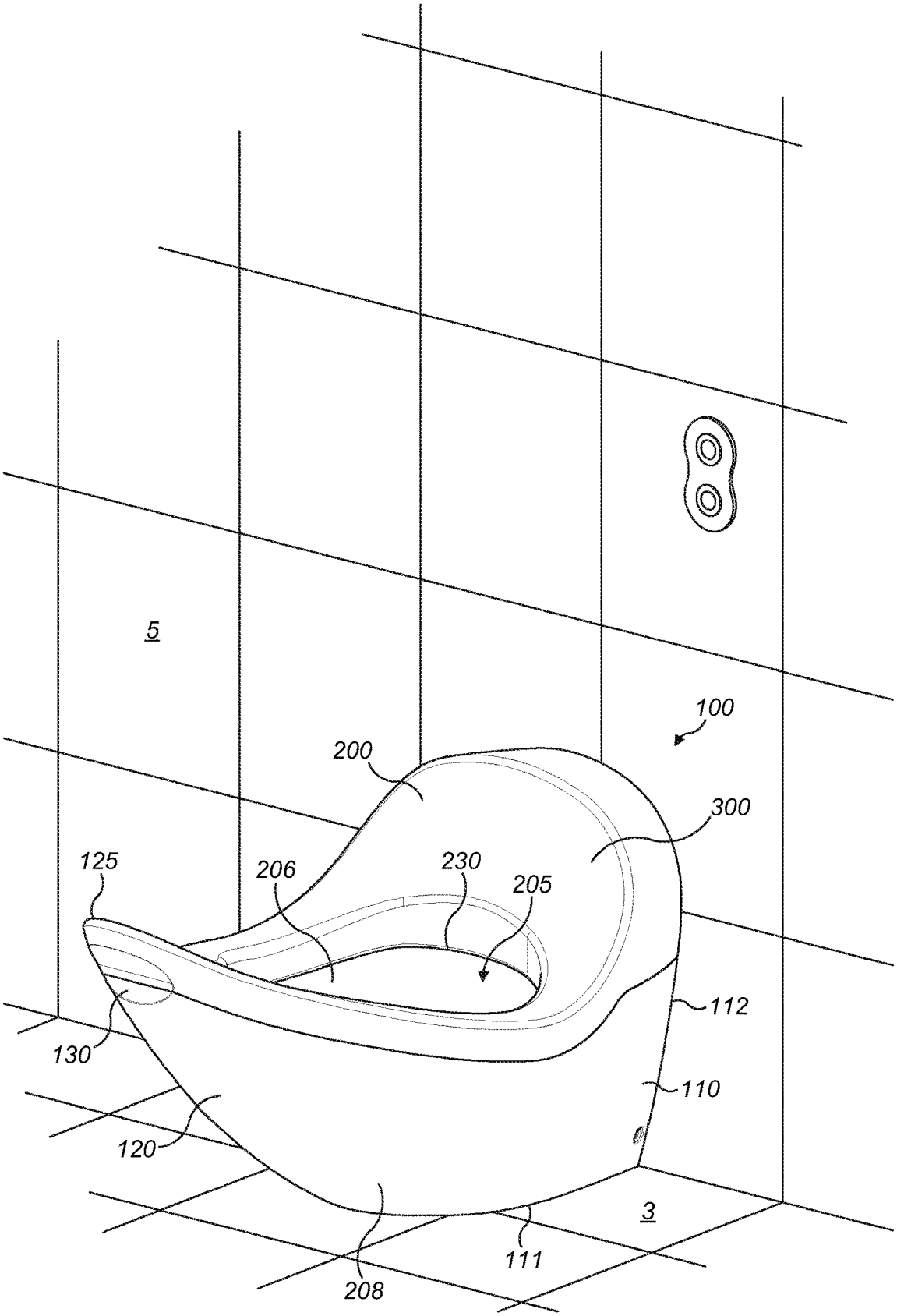

| | | | | | |
|---|---|---|---|---|---|
| 1,155,885 | A | * | 10/1915 | Catchings | A47K 17/028 4/420 |
| 2,000,658 | A | | 5/1935 | Bushold | |
| 2,099,118 | A | * | 11/1937 | Kennedy | A47K 13/00 4/420 |
| 2,703,409 | A | * | 3/1955 | Manning | E03D 11/13 4/311 |
| 4,012,797 | A | | 3/1977 | Kristoffersen | |
| 6,516,475 | B1 | | 2/2003 | Anderson | |
| 2003/0154541 | A1 | | 8/2003 | Miller | |
| 2009/0229046 | A1 | | 9/2009 | Liu | |

FOREIGN PATENT DOCUMENTS

| | | | | | |
|---|---|---|---|---|---|
| CN | 203341645 | U | | 12/2013 | |
| CN | 205636964 | U | | 10/2016 | |
| CN | 205712391 | U | | 11/2016 | |
| DE | 29919769 | U1 | | 3/2001 | |
| EP | 0369681 | A1 | | 5/1990 | |
| EP | 369681 | A1 | | 5/1990 | |
| FR | 1306690 | A | | 10/1962 | |
| GB | 567702 | A | * | 2/1945 | |
| GB | 567702 | A | | 2/1945 | |
| GB | 685960 | | | 1/1953 | |
| GB | 685960 | A | | 1/1953 | |
| GB | 2208121 | A | | 3/1989 | |
| GB | 2215748 | A | | 9/1989 | |
| GB | 2276890 | A | | 10/1994 | |
| JP | S63161981 | U | | 10/1988 | |
| JP | H07020996 | U | | 4/1995 | |
| JP | 2002129628 | A | | 5/2002 | |
| JP | 3096417 | U | | 9/2003 | |
| JP | 2003275133 | A | | 9/2003 | |
| JP | 2007070995 | A | | 3/2007 | |
| JP | 2010142283 | A | | 7/2010 | |
| KR | 20040004801 | A | | 1/2004 | |
| KR | 20040004801 | A | * | 1/2004 | |
| KR | 20100002420 | A | | 1/2010 | |
| KR | 20110045504 | A | | 5/2011 | |
| KR | 20160000983 | A | | 1/2016 | |
| RU | 2292428 | C2 | | 1/2007 | |
| TW | 255934 | B | | 9/1995 | |
| WO | 2008/117288 | A2 | | 10/2008 | |
| WO | 2010/016012 | A1 | | 2/2010 | |
| WO | 2010/030242 | A1 | | 3/2010 | |
| WO | WO-2013077818 | A1 | * | 5/2013 | E03D 11/02 |

* cited by examiner

TOILET FOR USE WHILE SQUATTING OR SITTING

CROSS-REFERENCE TO RELATED APPLICATIONS

This application is a national stage entry under 35 U.S.C. of 371 of PCT Patent Application No. PCT/GB2017/053634, filed Dec. 1, 2017, which claims priority to Great Britain Patent Application No. 1620742.5, filed Dec. 6, 2016, the entire contents of each of which is incorporated herein by reference.

This disclosure relates to a toilet and components thereof, including a toilet bowl, a toilet seat, a toilet lid, and flushing apparatus. Also described are methods for manufacturing such toilets and components, and materials suitable therefor. In particular, the toilet is for use when the user maintains a squatting posture.

It is well known that a squatting posture is the natural posture for defecation. Conventional modern toilets, particularly those sold in Western Europe and the US, require defecation to be carried out in a seated posture with a much more open hip angle than would be obtained during squatting. The natural squatting posture closes the hip angle and thereby relaxes the puborectalis muscle, which in turn allows the colon to straighten, so that defecation can take place more comfortably.

Conventional squatting toilets, for example a Japanese squatting toilet, are usually not much more than a hole in the floor. Sometimes, textured foot supports are provided for extra grip, and occasionally handles either side of the hole are provided for support. There are a number of designs of squatting toilets that provide a toilet bowl, but these require the removal of the user's clothing before use, since the user's feet must be placed either side of the toilet bowl.

A number of stools are currently available for elevating the feet of a user of a conventional modern toilet so as to achieve an acute hip angle in a seated position. This solution is not ideal, however, since the user's feet cannot be located far enough rearward to allow the user to support their weight without sitting.

This disclosure provides a toilet that can be used for both squatting use and for seated use.

According to the invention there is provided a toilet bowl as defined by claim 1 or 38, 39 or 42, a toilet defined by claim 23 or 41, and a method of manufacturing a toilet seat defined by claim 36 or 47.

Figure 1B:
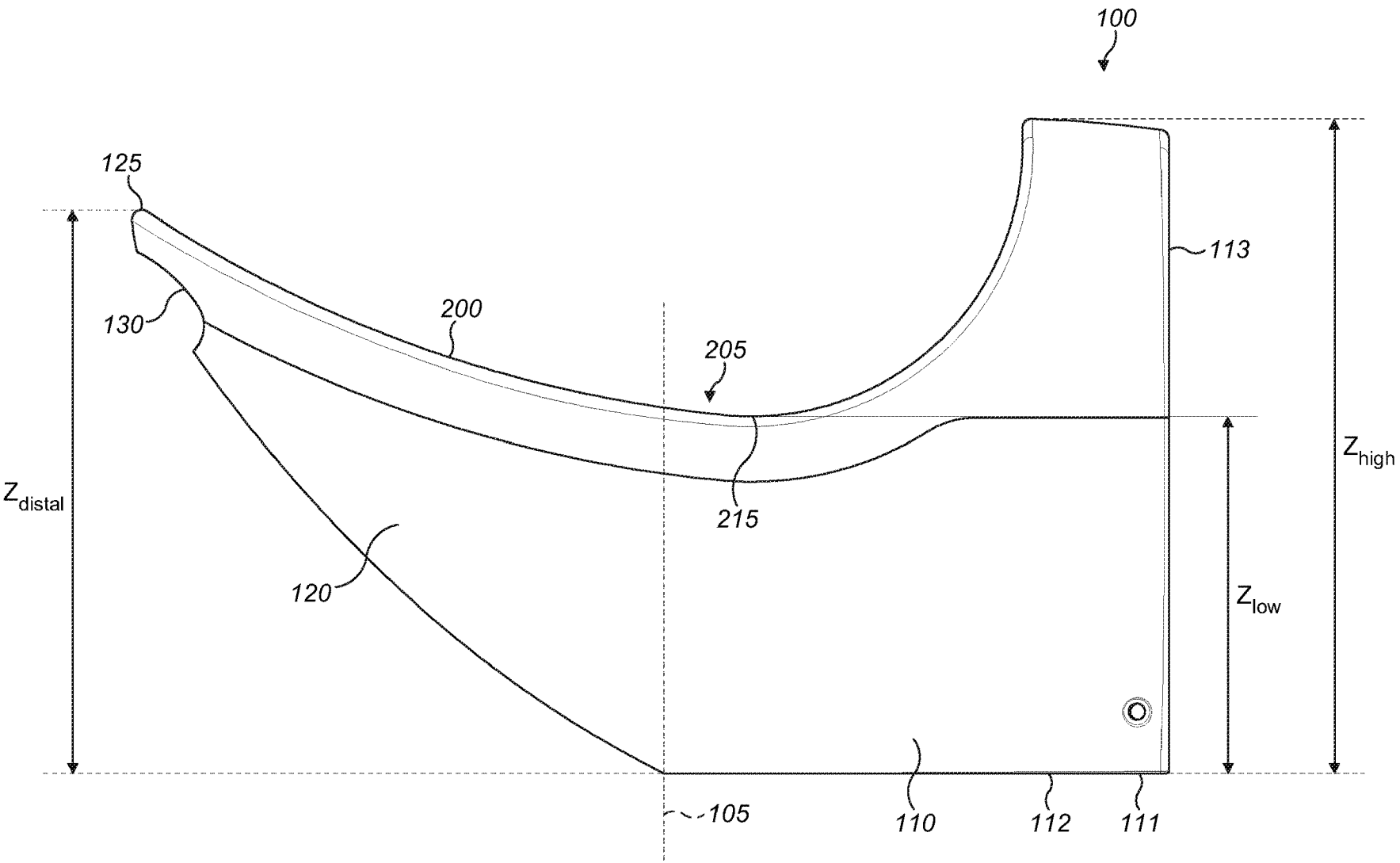

For a better understanding of the invention, and to show how the same may be put into effect, reference will now be made, by way of example only, to the accompanying drawings in which:

FIG. 1*a* shows a perspective view of a toilet bowl;

FIG. 1*b* shows a side view of the toilet bowl of FIG. 1*a;*

Figure 1C:
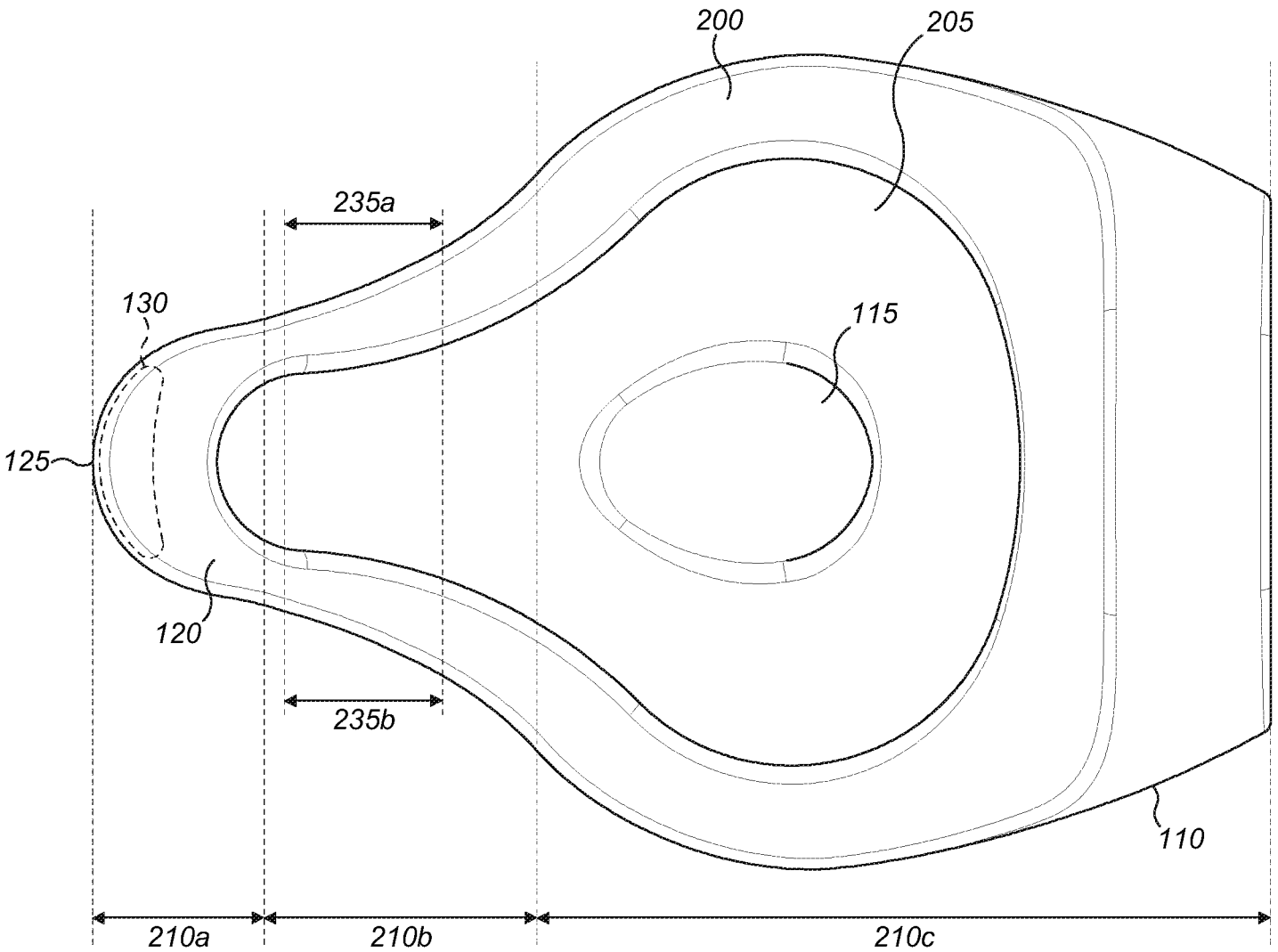

FIG. 1*c* shows a plan view of the toilet bowl of FIG. 1*a;*

Figure 1D:
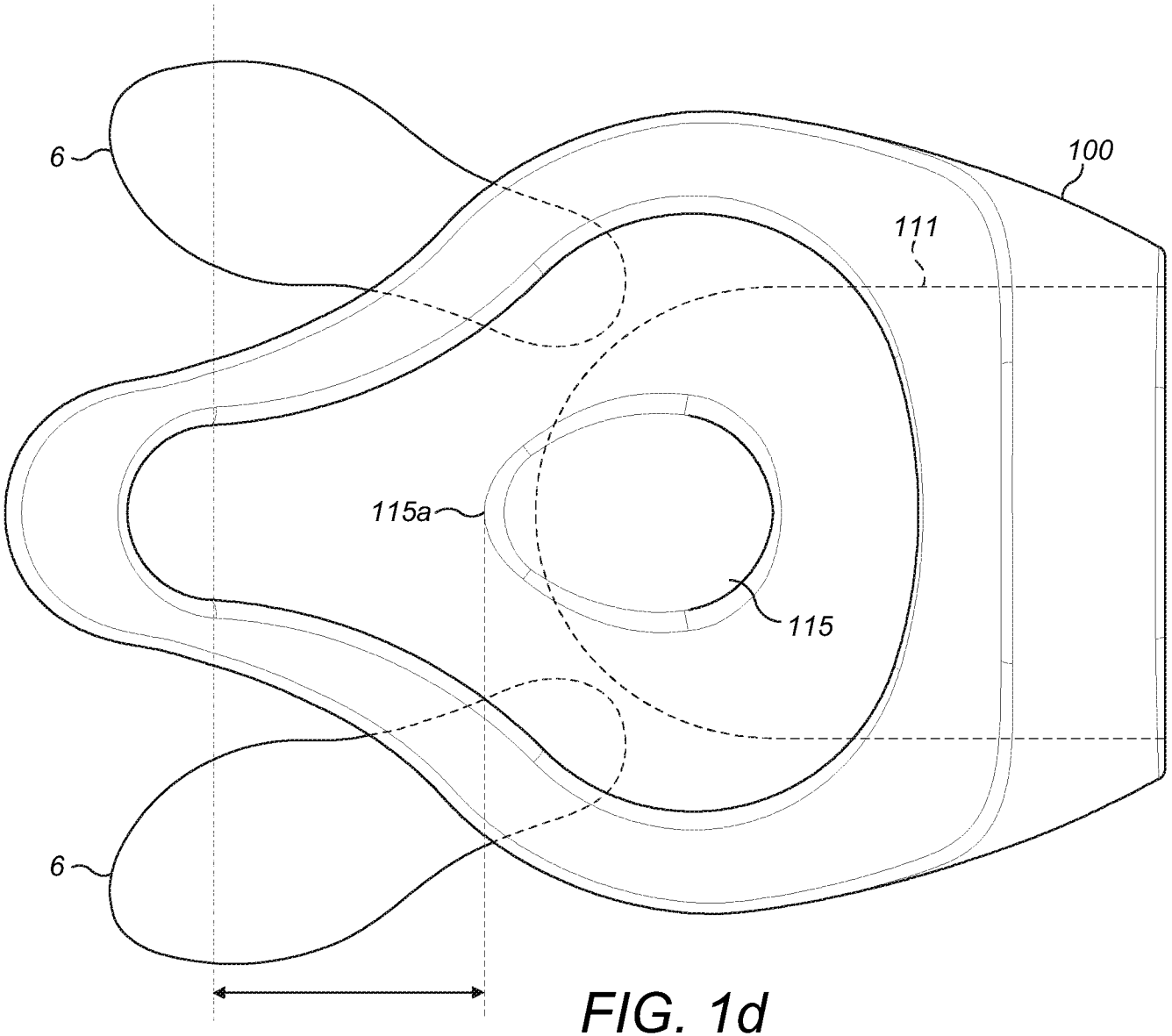
Figure 2A:
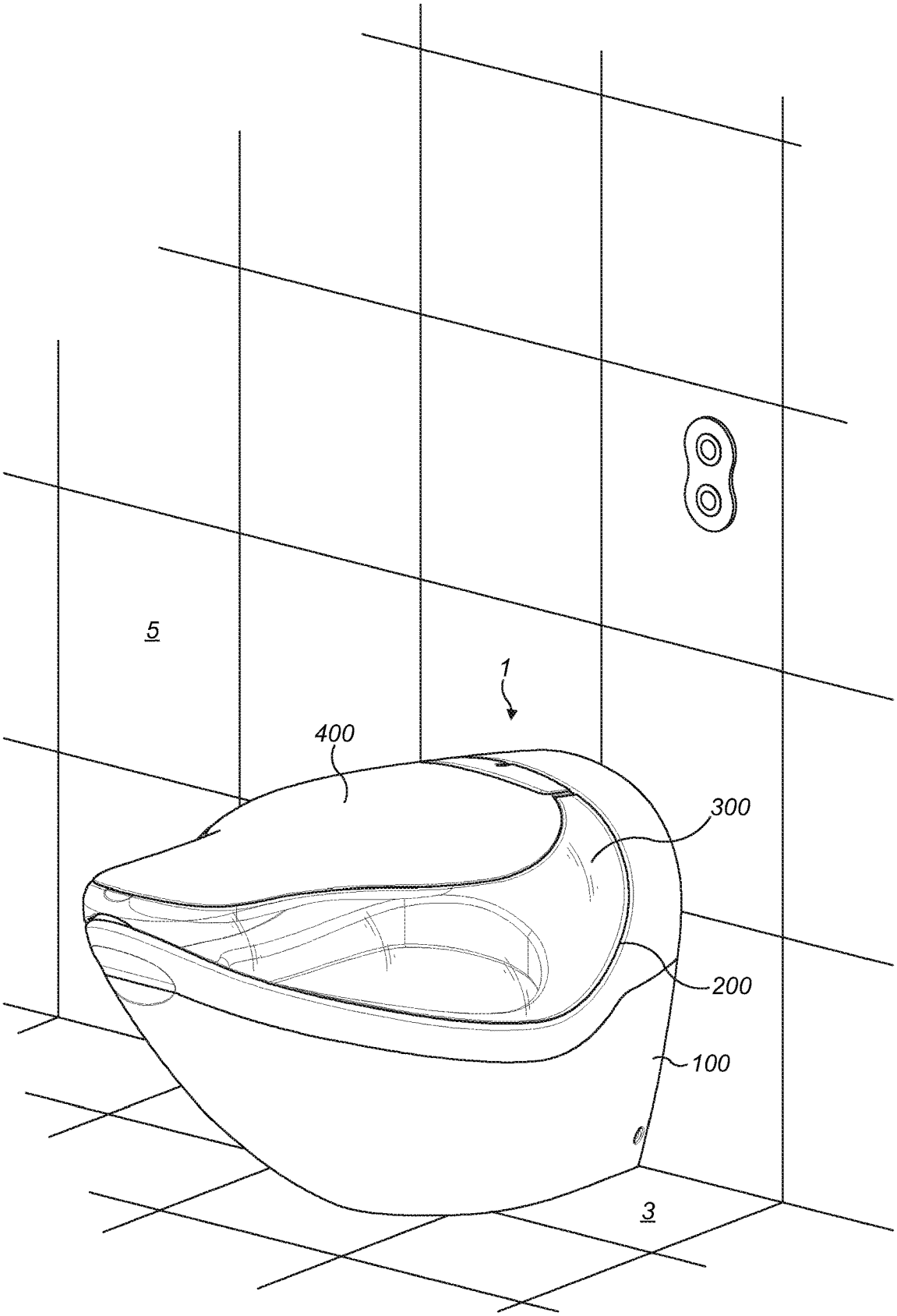
Figure 2B:
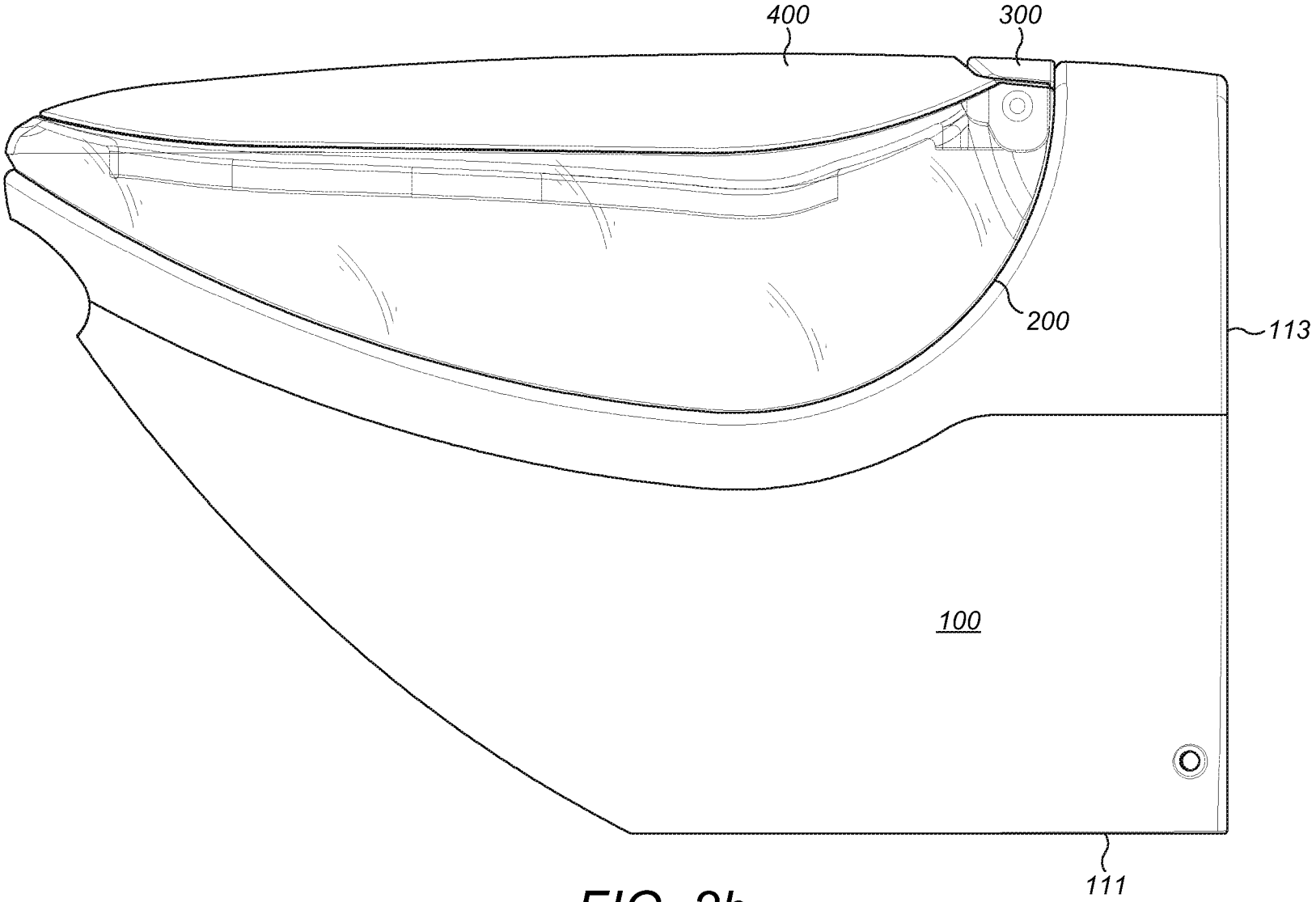

FIG. 1*d* shows schematically a plan view identifying the location of a user's feet during squatting use;

FIG. 2*a* shows a perspective view of a toilet;

FIG. 2*b* shows a side view of the toilet of FIG. 2*a;*

Figure 2C:
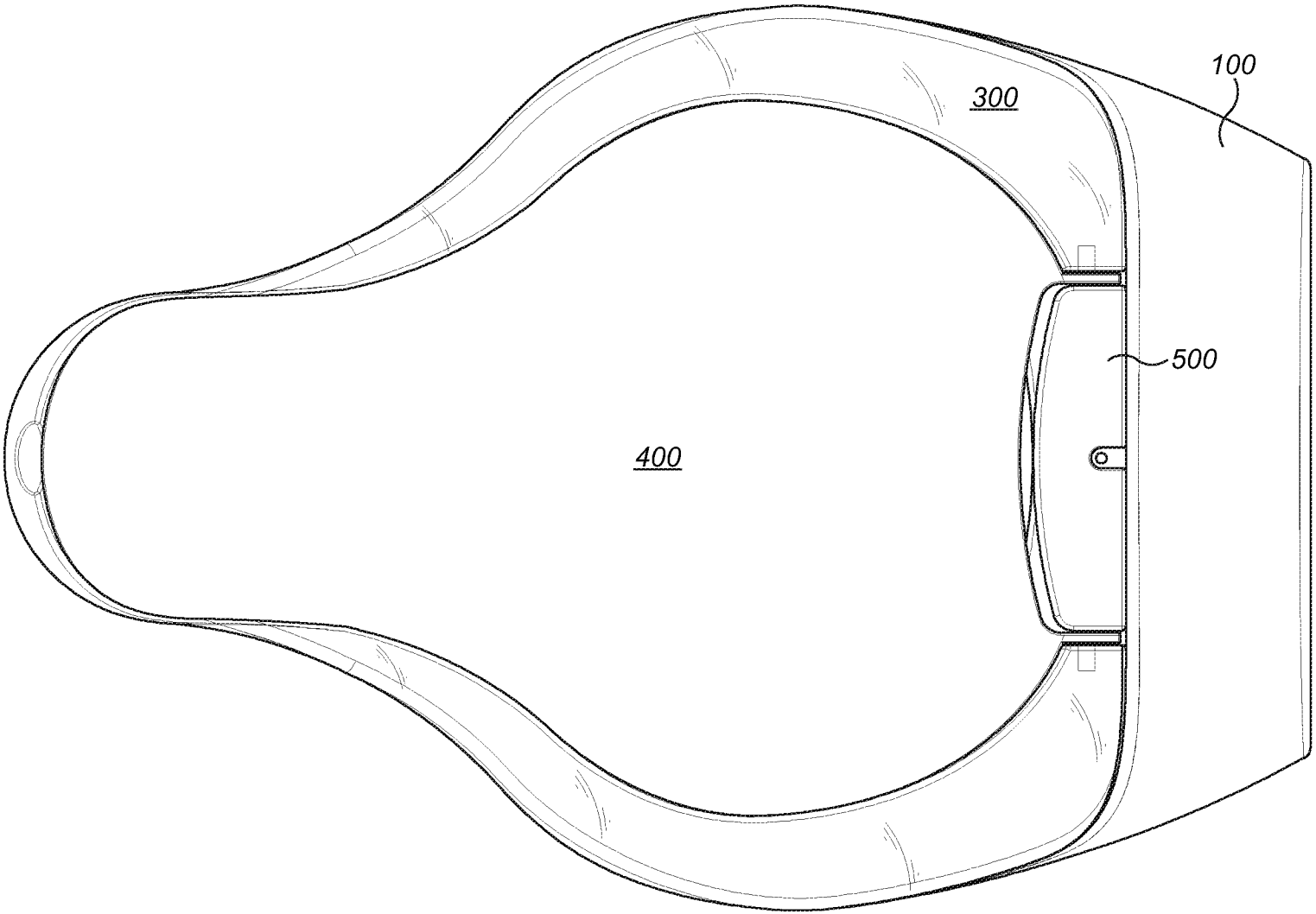

FIG. 2*c* shows a plan view of the toilet of FIG. 2*a;*

Figure 3A:
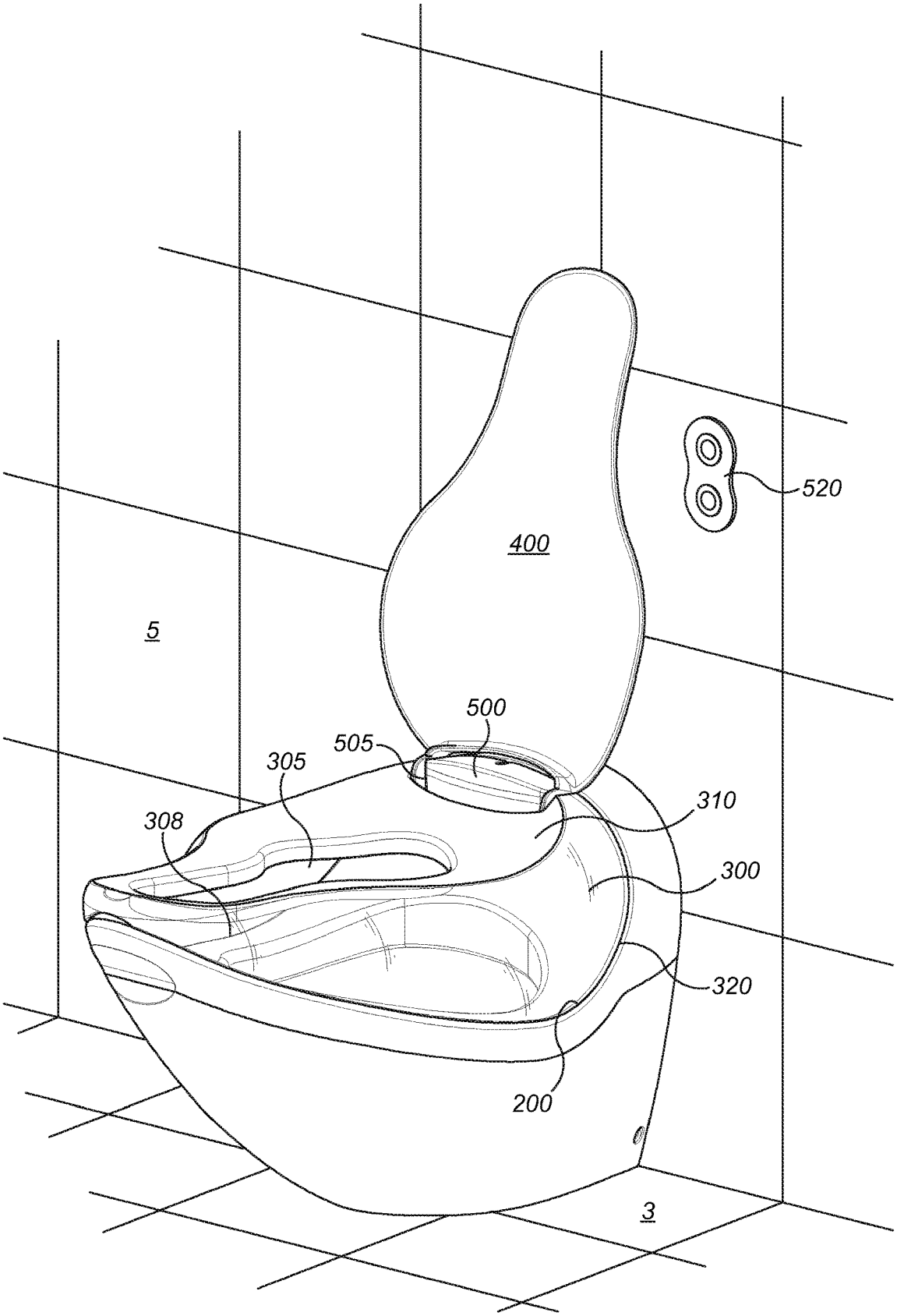
Figure 3B:
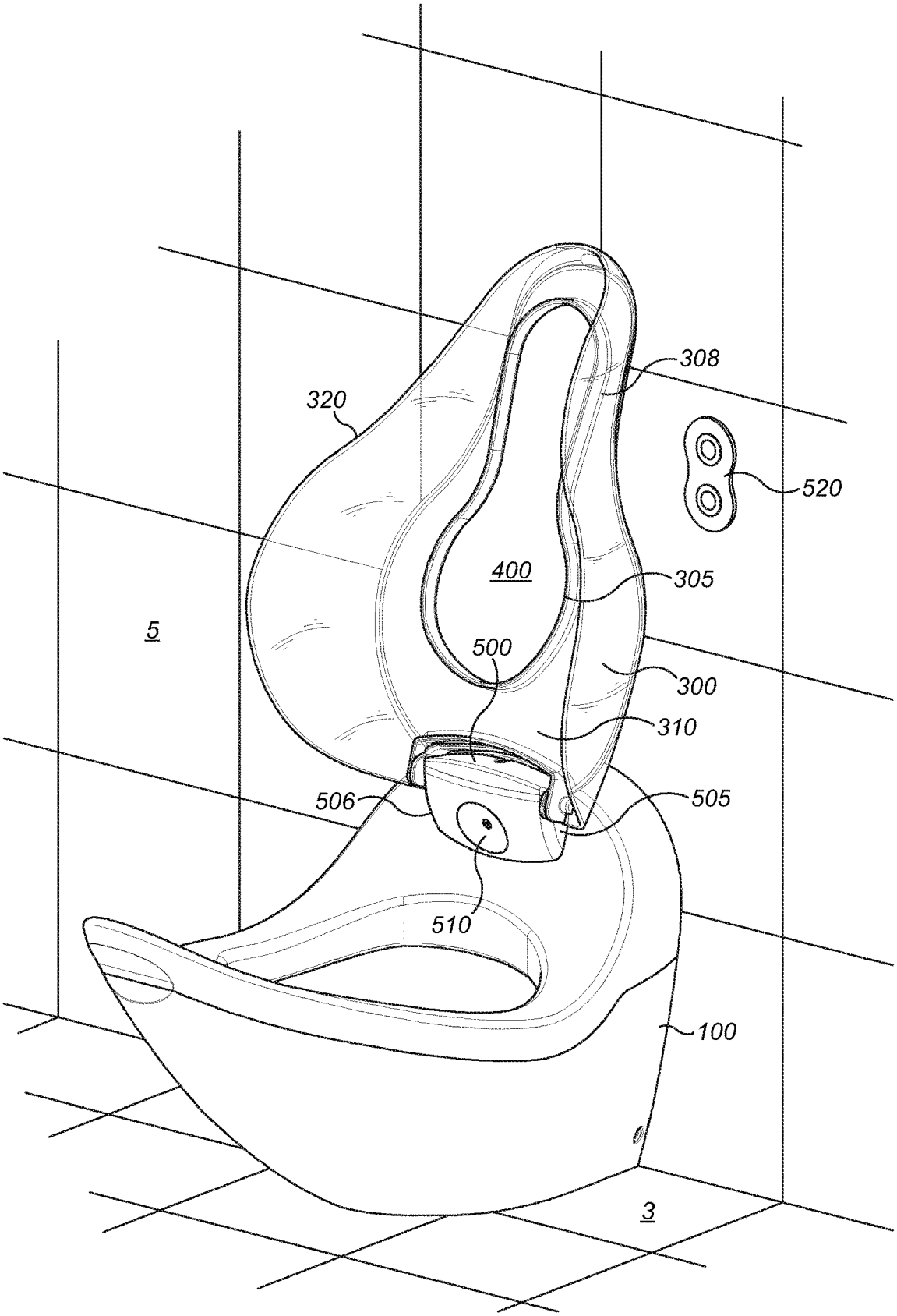

FIG. 3*a* shows a perspective view of the toilet of FIG. 2*a* with a lid in an open position;

FIG. 3*b* shows a perspective view of the toilet of FIG. 2*a* with a support in an open position;

and

Figure 3C:
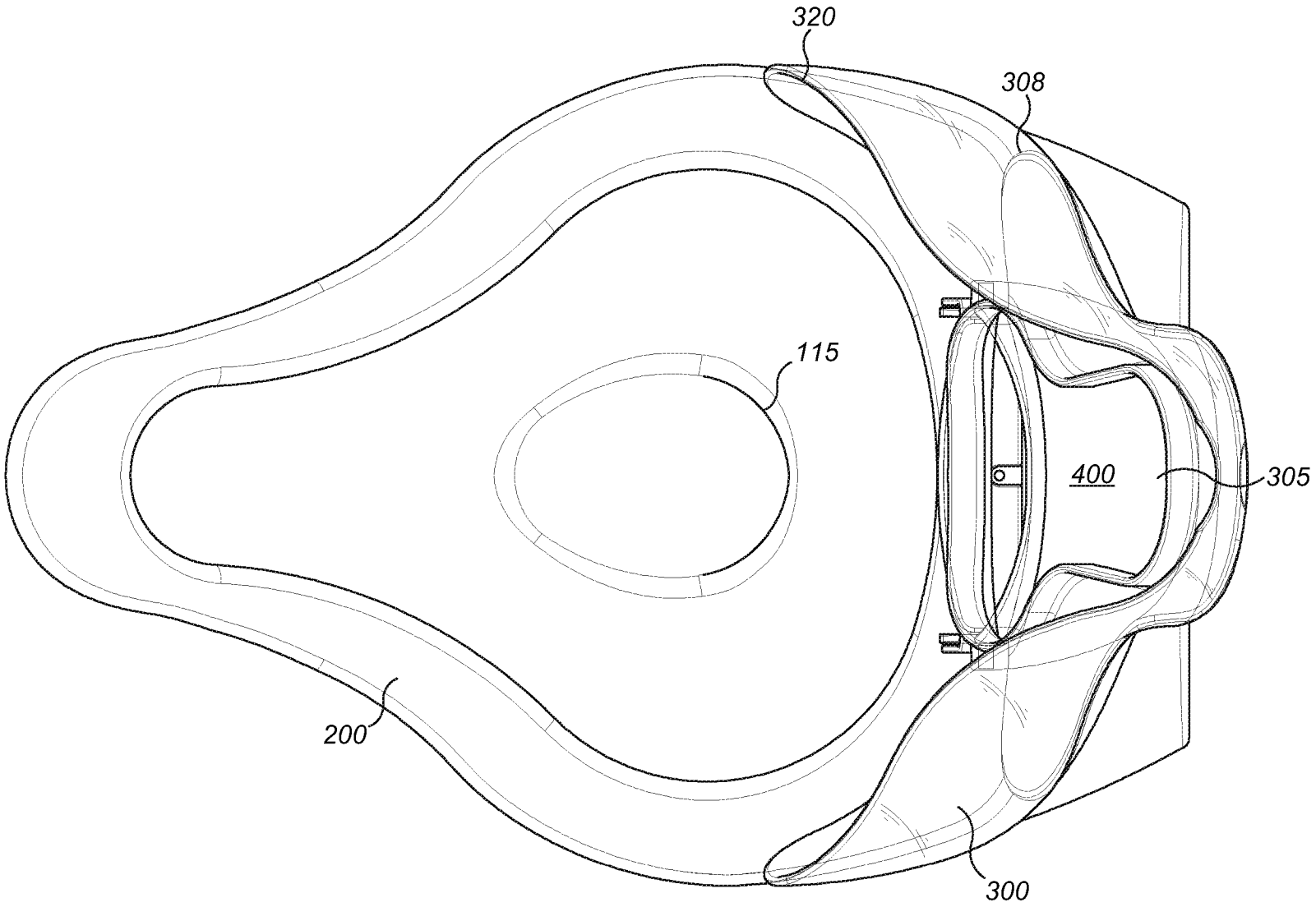

FIG. 3*c* shows a plan view of the toilet of FIG. 2*a* with a support in an open position.

FIGS. 1*a*, 1*b* and 1*c* show a toilet bowl 100 for a squatting toilet 1. The toilet bowl 100 includes a rim 200, an outlet 115, an outer surface 208, and an inner surface 206. The rim 200 defines an opening 205 into a concave space for holding water and/or faeces.

The outlet 115 for waste is provided in the lower most part of the toilet bowl 100 (when installed correctly). An inlet (not shown) is provided for supplying water for flushing the contents of the toilet bowl 100 towards the outlet 115.

The toilet bowl 100 may be configured to be part of a floor-supported toilet 1, in which case it would include a flat base 111 for contacting the floor 3. This is preferable, owing to the length of the toilet bowl 100, because the base 111 can support the load of a user. The flat base 111 could be a planar surface, or simply an edge of the toilet bowl 100 lying in a plane that can contact a flat floor 3 to support the toilet bowl 100.

Alternatively, the toilet bowl 100 may be configured to be part of a wall-supported toilet 1, in which case it would include a flat rear edge or surface 113 for abutment with a wall 5. Fasteners (not shown) may be provided to attach the toilet bowl 100 to the wall 5 and to carry any load applied to the toilet bowl 100. The flat base 111 is therefore optional.

Both a base 111 and a flat rear edge or surface 113 are provided. For example, the base 111 may carry the majority of the vertical load, while the toilet may communicate with a water supply and/or waste pipe via the wall 5.

In any event, the toilet bowl 100 defines a forward direction, which—when the toilet 1 is correctly installed—extends perpendicular to the plane of the wall 5. The forward direction corresponds to the horizontal direction in which a user would face when sat correctly on the toilet bowl 100.

Perpendicular to the forward direction, the toilet bowl 100 defines a transverse direction. The transverse direction is perpendicular to the forward direction and parallel to the plane of a flat floor 3 if supporting the toilet bowl 100. The transverse direction may also correspond to the direction of a straight line between the two lowest points 215 on either side of the rim 200 (as described below).

The vertical direction is perpendicular to both the forward direction and the transverse direction the toilet bowl 100. The vertical direction is perpendicular to the flat base 111, if provided. The vertical direction is parallel to the plane of the flat rear edge or surface 113, if provided.

The toilet bowl 100 is shaped to define a rearward portion 110 an elongate frontal extension 120. The opening 205 extends through both the rearward portion 110 and the frontal extension 120. The frontal extension 120 extends forward of a plane 105. When a base is provided, the frontal extension 120 extends from the frontal edge of the base 111 in the forward direction. The rearward portion 110 includes the outlet 115 for waste, the optional flat base 111, and the optional flat rear edge or surface 113.

The frontal extension 120 has a length of between 290 mm and 380 mm in the forward direction, and may be 330 mm.

The rearward portion 110 has a length of between 240 mm and 300 mm in the rearward direction, and may be 270 mm.

The frontal extension 120 is sized and shaped for a user to straddle. In this connection, and as best shown in FIG. 1*c*, the rim 200 has in plan view (i.e. in a plane perpendicular to the vertical direction) a profile that may include a convex rearward section 210*c* connected to a convex distal end 210*a* via two concave side sections 210*b*. The distal end 210*a* and two concave side sections 210*b* collectively define the portion of the profile of the rim 200 lying in the frontal extension 120, while the rearward section 210*c* of the rim 200 lies in the rearward portion 110 of the toilet bowl 100.

The two concave side sections 210*b* may extend from the rearward section 210*c* to collectively define a forward section 210*a* that is narrower in the transverse direction than the rearward section 210*c* in plan view. Such a profile could be described as generally pear-shaped in plan view.

The width of the frontal extension 120 in the transverse direction does not exceed 200 mm in the forwardmost 190 mm of the frontal extension 120. This is advantageous, since it allows the user to stand and squat with the frontal extension 120 of the toilet bowl 100 extending between the user's legs. In this way, the toilet bowl 100 can be used for simultaneous defecation and urination while the user squats.

Most advantageously, the frontal extension 120 is elevated relative to the lowest point 112 of the toilet bowl 100. The lowest point 112 may correspond to the base 111. This can provide a clearance beneath the frontal extension 120 between the toilet bowl 100 and the floor 3.

The elevation is achieved by inclining the frontal extension 120 relative to the floor 3 and/or base 111 of the toilet bowl 100. This can provide a clearance beneath the frontal extension 120 between the toilet bowl 100 and the floor 3.

The clearance between the frontal extension 120 and the floor 3 and/or base 111 of the toilet bowl 100 is greater than 60 mm in height at every point forwardly from the transversely aligned locations intended for users to place their feet 6. In this way, the users may retain their underwear/other clothing around their ankles when squatting over the toilet bowl 100.

In the floor-mounted embodiment, the clearance can be achieved by the outside surface 208 of the toilet bowl 100 being inclined relative to the base 111 (i.e., upwardly when installed).

With reference to FIG. 1*d*, it is intended that the users would aim to defecate directly into the outlet 115. For a user of typical size in a squat, the transversely aligned locations of the balls of the users' feet 6 will therefore be approximately 0 mm to 100 mm ahead of the forwardmost edge 115*a* of the outlet 115. Accordingly, the clearance is greater than 100 mm over the portion of the frontal extension 120 that extends from the distal end 125 of the frontal portion 120 to approximately 100 mm ahead of the forwardmost 115a edge of the outlet 115. As can be seen in FIG. 1*d*, the base 111 therefore extends only slightly ahead of the outlet 115.

Similarly, since this portion of the toilet bowl 100 is intended to extend between the users' legs, the width in the transverse direction of the frontal portion 120 from the distal end 125 to approximately 100 mm ahead of the forwardmost edge 115*a* of the outlet 115 is in the range 150 mm to 250 mm, and may be 200 mm.

The rearward portion 110 does not need to be straddled and so can be wider. For reasons that will be apparent from the following, the rearward portion 110 has a width of at least 400 mm in a transverse direction, and is may be at least 450 mm wide. In certain embodiments, the width is less than 500 mm.

As can be seen from FIGS. 1*a* and 1*b*, the frontal extension 120 is upwardly inclined relative to the floor 3 (and/or is upwardly inclined relative to the optional flat base 111, and/or is upwardly inclined relative to a line perpendicular to the flat rear edge or surface 113, and/or is upwardly inclined relative to a line perpendicular to the surface of the wall 5).

The height $Z_{distal}$ of the distal end 125 of the frontal extension 120 above the base 111 is in the range 300 mm to 500 mm, and may be 350 mm to 420 mm. Any higher than this, and it would be too difficult for a user to walk backwards into the appropriate location for squatting use. If lower than this, there is a risk that urine might not be caught by the opening 205 in the frontal extension 120. In embodiments of toilets 1 that do not rest on a base 111, such as wall mounted toilets, $Z_{distal}$ is the height from the floor 3 in the vertical direction when installed.

Advantageously, since the frontal portion 120 is inclined, a handle 130 may be provided at the distal end 125 of the frontal extension 120. When squatting, a user may hold the handle 130, allowing the user's centre of gravity to be located further backwards than would be possible without support. The handle 130 may be formed by shaping the frontal extension 120, or may be provided in addition to the frontal extension 120.

To accommodate the user when squatting, the rim 200, which defines the upper surface of the toilet bowl 100, is also inclined in the forward direction in the frontal extension 120.

The rim 200 increases in height forwardly of the two lowest points 215 transversely aligned in the rearward portion 110. The rim 200 also increases in height rearwardly of the two lowest points 215. Therefore, when viewed in a side profile plane defined by the vertical and forward directions, the rim 200 has a concave profile.

The rim 200 forms a smooth curve to avoid discontinuities. Therefore, when viewed in the side profile plane, the rim 200 defines a U-shaped curve. The U-shaped curve is skewed forwardly, for example such that rim 200 forward of the lowest point 215 has a shallower incline than the rim 200 rearward of the lowest point 215.

The outer surface 208 of the toilet bowl 100 includes a wall extending from the base 111 to the rim 200. The height $Z_{low}$ of the wall in a direction perpendicular to the base 111 is lowest at the two lowest points 215. The lowest height $Z_{low}$ of the wall in a direction perpendicular to the base is in the range 180 mm to 240 mm. In embodiments of toilets 1 that do not rest on a base 111, such as wall mounted toilets, $Z_{ion}$, is the height of the lowest points 215 of the rim 200 from the floor 3 in the vertical direction when installed.

The highest height $Z_{high}$ of the rim 200 of the toilet bowl 100 in the rearward portion 110 in a direction perpendicular to the base 111 is in the range 350 mm to 450 mm, and may be 400 mm. In embodiments of toilets 1 that do not rest on a base 111, such as wall mounted toilets, $Z_{high}$ is the highest height of the rim 200 in the rearward portion 110 of the toilet bowl 100 from the floor 3 in the vertical direction when installed.

FIGS. 2*a*, 2*b* and 2*c*, and FIGS. 3*a*, 3*b* and 3*c* show a toilet 1, which may include the toilet bowl 100 of FIGS. 1*a* to 1*c*.

The toilet 1 includes a support 300 and a lid 400. The support 300 is essentially a toilet seat having a greater than conventional depth. Each of the support 300 and lid 400 are pivotably attached to the toilet bowl 100. A hinge 505 may be provided for connecting either or both of the support 300 and/or lid 400 to the toilet bowl 100. The hinge axis is in parallel with the transverse axis. Both the support 300 and the lid 400 pivot about the same axis.

The support 300 is arranged for supporting a user above the opening 205 of a toilet bowl 100. The support 300 includes an opening 305 through which a user seated on the support 300 may defecate into the toilet bowl 100.

The support 300 is arranged to pivot between an open position (shown in FIG. 3*b*) and a closed position (shown in FIG. 3*a*). In the open position the support 300 is rotated away from the toilet bowl 100. In the closed position the support 300 abuts the rim 200.

The support 300 has an outermost edge 320. The shape of the outermost edge 320 generally corresponds with that of the rim 200 of the toilet bowl 100. In some embodiments, the outermost edge 320 may extend around the majority of the support 300. The outermost edge 320 extends around more than 90% of the support 300. As depicted in the Figures, the outermost edge 320 extends around all of the support 300 except for the section contacting the hinge 505. In this way, when closed, the full length of the outermost edge 320 contacts the rim 200 or is adjacent the hinge.

The support 300 is arranged such that when the outermost edge 320 abuts the rim 200 of the toilet bowl 100 the outer surface 308 of the support 300 and the outer surface 208 of the toilet bowl form a contiguous surface extending across the line of abutment.

Since the height at which a user would most comfortably sit is considerably higher than the height at which the user would squat, it is necessary for the support to have a significant height. The support 300 therefore has a concave cross-section in a plane perpendicular to the forward direction. The support 300 therefore has a concave cross-section in a plane perpendicular to the forward direction over the majority of its length in the forward direction. The support 300 therefore has a concave cross-section in a plane perpendicular to the forward direction over at least 90% of its length in the forward direction.

As can be seen from FIG. 3*c*, since the support 300 has a concave cross-section, it must be reasonably wide to avoid obstructing a user when squatting. Therefore, the width of the rearward portion 110 of the toilet bowl 100 is at least 400 mm in a transverse direction and more, at least 450 mm. The width of the rearward portion 110 of the toilet bowl 100 is no more than 500 mm in a transverse direction.

Since the shape of the rim 200 of the toilet bowl 100 corresponds with the shape of the support 300, the maximum width of the support 300 is at least 400 mm in a transverse direction and more, at least 450 mm. The maximum width of the support 300 is no more than 500 mm in a transverse direction. The maximum width of the support 300 corresponds with the distance between the points on the outermost edge 320 that contact the lowest points 215 of the rim 200. This allows the user to squat without obstructions by, or undesirable contact with, the inner surface of the support 300.

The support 300 has a substantially flat seat portion 310. The seat portion 310 may surround the opening 305. The seat portion 310 of the support 300 may include or be formed of an elastomer.

The support 300 has a maximum height in the range of 110 mm to 200 mm and 120 mm to 170 mm (this corresponds to the lowest point 215).

As a result of the height of the support, it must be made of rigid material and cannot be too thick owing to its size. Accordingly, support 300 may include or is formed from a rigid thermosetting plastic, such as polycarbonate.

The support 300 may include a hydrophobic material, more a superhydrophobic material. The material may be a coating on the inner surface of the support 300, or may be distributed throughout the support material 300.

The support 300 is formed by co-moulding a first material for forming a structural part of the support 300 with the seat material. The support 300 is formed by co-moulding an elastomer for forming the seat portion 310 with a thermosetting plastic (such as polycarbonate), optionally including a hydrophobic material, for forming a structural part of the support 300.

The lid 400 is arranged to pivot between an open position (shown in FIG. 3*a*) and a closed position (shown in FIG. 2*a*). In the open position, the lid 400 is rotated away from the support 300. It may, for example, rest against the wall 5.

In the closed position, the lid 400 abuts the support 300 and closes the opening 305 in the support 300.

When both the lid 400 and the support 300 are in their respective closed positions, they collectively close the opening 205 of the toilet bowl 100. This can substantially contain any vapour/aerosol within the toilet 1, thereby providing a more hygienic toilet 1.

For the same reasons, the opening 305 in the support 300 has a width in the transverse direction in the range 400 mm (e.g., 450 mm) to 500 mm.

Preferably, one or both of the support 300 and/or lid 400 are moved between respective open and closed positions by an actuator (not shown). The actuator is triggered by one or more non-contact sensors 520.

In certain embodiments, the hinge 505 may be part of a hinge assembly 500 includes a nozzle 510 for directing a jet of water forwardly into the toilet bowl 100. The nozzle 510 may be connected to a supply of water for use as a bidet.

Similarly, a further nozzle (not shown) may be mounted on the frontal extension 120 (e.g., at the distal end 125) for directing a jet of water rearwardly into the toilet bowl. The further nozzle may be connected to a supply of water for use as a bidet. Such a frontal nozzle may provide a more hygienic bidet for a female user.

A typical flushing approach is to provide a supply of water to a channel extending around the top of the bowl. This water overflows along the length of the ridge providing a flow of water into the bowl around the majority of its circumference. Owing to the height of the distal end 125 of the frontal extension 120 of the disclosed toilet 1, such a toilet 1 is difficult to flush.

Certain embodiments, therefore include an inlet (not shown) for a supply of water and a ridge 230 within the toilet bowl 100 generally in parallel with at least a portion of the rim 200.

The ridge 230 defines a channel in communication with the inlet for carrying flush water around the periphery of the toilet bowl 100. Whilst a majority of the channel is open for allowing flush water to flow into the toilet bowl 100 as in conventional flushes, in the an embodiment two lengths of the channel are closed. The channel may be open by the provision of a plurality of spaced holes in the base of the channel, or by one or more slots extending along its length. The closed portions of the channel would not include such holes or slots.

With reference to FIG. 1*c*, the closed lengths of the channel may prevent water from flowing into the toilet bowl 100 over their respective extents 235*a*, 235*b*. The closed lengths extend along respective sides of the frontal extension 120. The channel is open at the forwardmost extent (near the distal end 125) of the frontal extension 120.

By the provision of the closed lengths, it is possible to contain the flow of water for the flush over some of the inclined channel, thereby providing sufficient pressure for the flush water to reach the higher parts of the frontal extension 120.

The invention claimed is:

1. A toilet comprising:

a toilet bowl for a squatting toilet, comprising:

a flat base configured to contact a floor, the base including an outlet, the flat base defining a plane that includes a forward direction and a transverse direction perpendicular to the forward direction; and a rim defining an opening of the toilet bowl, and a support structure configured to support a user above the opening of the toilet bowl, the support structure pivotably attached at a section of the support structure to the toilet bowl with a hinge assembly to pivot between an open position in which the support structure is rotated away from the toilet bowl and a closed position in which the support structure abuts the rim, wherein:

the toilet bowl is shaped to define a rearward portion including the flat base configured to contact the floor and an elongate frontal extension for the user to straddle, the frontal extension extending in the forward direction by at least 290 mm from the rearward portion;

at least a portion of the frontal extension is elevated or inclined relative to the flat base and configured to provide a clearance between the toilet bowl and the floor, and the rim extends around the periphery of both the frontal extension and the rearward portion, wherein the rim is inclined relative to the base in the forward direction throughout the frontal extension;

the width of the frontal extension in the transverse direction does not exceed 200 mm in a forwardmost 190 mm of the frontal extension;

the rim has a profile in plan view that includes a convex rearward section connected to a convex elongate frontal section via two concave side sections;

the support structure has an outermost edge shaped to correspond with the rim of the toilet bowl, the outermost edge extending around all of the support structure except for the section of the support structure attached to the toilet bowl with the hinge assembly, a full length of the outermost edge contacting the rim or adjacent the hinge assembly in the closed position;

the support structure has a flat seat portion, the seat portion surrounding an opening in the support structure; and the support structure is configured such that at least part of the seat portion is at least 110 mm from the rim.

2. The toilet of claim 1, wherein the rim is inclined relative to the base in the frontal extension in a side profile plane perpendicular to the base and extending in the forward direction, wherein the rim is concave in the side profile plane.

3. The toilet of claim 1, wherein the rim has a skewed U-shaped profile in a side profile plane, with a forwardmost extent of the rim having a shallower inclination relative to the base than a rearmost extent.

4. The toilet of claim 1, wherein a minimum height of the rearward portion coincides with the outlet in the forward direction.

5. The toilet of claim 1, wherein a wall extends from the base to the rim, and a height of the wall in a direction perpendicular to the base is lowest in the rearward portion.

6. The toilet of claim 1, wherein the frontal extension is shaped to provide a handle at a forwardmost extent of the frontal extension.

7. The toilet of claim 1, further comprising a lid configured to close the opening in the support structure so that the lid and support structure can collectively close the opening of the toilet bowl.

8. The toilet of claim 7, wherein:

the lid is pivotably attached to the toilet bowl;

the lid is configured to pivot between an open position and a closed position;

in the open position the lid is rotated away from the support structure;

in the closed position the lid abuts the support structure and closes the opening in the support structure; and when both the lid and the support structure are in their respective closed positions, they collectively close the opening of the toilet bowl.

9. The toilet of claim 1, wherein the support structure is configured such that when the outermost edge abuts the rim of the toilet bowl an outer surface of the support structure and an outer surface of the toilet bowl form a contiguous surface extending across the abutment.

10. The toilet of claim 1, further comprising:

an actuator configured to move the support structure between the open and closed positions; and a non-contact sensor configured to trigger the actuator.

11. The toilet of claim 1, wherein the hinge assembly includes a nozzle configured to direct a jet of water into the toilet bowl.

12. The toilet of claim 1, further comprising a nozzle mounted on the frontal extension configured to direct a jet of water into the toilet bowl.

13. The toilet of claim 1, further comprising:

an inlet configured to provide a supply of water; and a ridge within the toilet bowl in parallel with at least a portion of the rim, wherein:

the ridge defines a channel in communication with the inlet configured to carry water around the periphery of the bowl;

a majority of the channel is open to allow water to overflow into the toilet bowl;

two lengths of the channel are closed to prevent water from overflowing into the toilet bowl;

the closed lengths extend along respective sides of the frontal extension; and the channel is open at a forwardmost extent of the frontal extension.

14. The toilet bowl of claim 1, wherein a handle is provided at a distal end of the frontal extension.

15. The toilet bowl of claim 1, wherein the frontal extension is upwardly inclined relative to the flat base.

16. The toilet of claim 1, wherein the support structure is configured such that at least part of the seat portion is at least 120 mm from the rim.

17. The toilet of claim 1, wherein the support structure has a maximum height of less than 200 mm.

18. The toilet of claim 1, wherein the support structure has a maximum height of less than 170 mm.

19. A toilet for use as either a squatting toilet or a seated toilet, comprising:

a toilet bowl having a rim defining an opening;

wherein:

the toilet bowl is shaped to define a rearward portion including the base and an elongate frontal extension for a user to straddle, the frontal extension extending in the forward direction by at least 290 mm from the rearward portion;

a portion of the frontal extension is elevated or inclined relative to the base and configured to provide a clearance between the toilet bowl and a floor, and the rim extends around the periphery of both the frontal extension and the rearward portion, wherein the rim is inclined relative to the base in the forward direction throughout the frontal extension; and a support structure configured to support the user above the opening of the toilet bowl, the support structure pivotably attached at a section of the support structure to the toilet bowl with a hinge assembly to pivot between an open position in which the support structure is rotated away from the toilet bowl and a closed position in which the support structure abuts the rim, wherein:

the support structure has an outermost edge shaped to correspond with the three-dimensional shape of the rim of the toilet bowl and a flat seat portion surrounding an opening in the support structure;

the support structure is configured such that at least part of the seat portion is at least 110 mm from the rim;

the width of the frontal extension in the transverse direction does not exceed 200 mm in a forwardmost 190 mm of the frontal extension;

the outermost edge extends around all of the support structure except for the section of the support structure attached to the toilet bowl with the hinge assembly, a full length of the outermost edge contacting the rim or adjacent the hinge assembly in the closed position.

20. The toilet of claim 19, wherein the support structure is configured such that at least part of the seat portion is at least 120 mm from the rim.

21. The toilet of claim 19, wherein the support structure has a maximum height of less than 200 mm.

22. The toilet of claim 19, wherein the support structure has a maximum height of less than 170 mm.

23. A toilet for use as either a squatting toilet or a seated toilet, comprising:

a toilet bowl for a squatting toilet, comprising a rearward portion including an outlet and a frontal extension for a user to straddle, the toilet bowl having a rim defining an opening;

wherein:

the rearward portion includes a flat base;

the frontal extension extends in a forward direction from the rearward portion;

at least a portion of the frontal extension is elevated or inclined relative to the flat base of the rearward portion and configured to provide a clearance between the toilet bowl and a floor on which the flat base rests, and the rim extends around the periphery of both the frontal extension and the rearward portion, wherein the rim is inclined relative to the flat base in the forward direction throughout the frontal extension; and a support structure with a concave cross-section configured to support the user above the opening of the toilet bowl, the support structure pivotably attached at a section of the support structure to the toilet bowl with a hinge assembly to pivot between an open position in which the support structure is rotated away from the toilet bowl and a closed position in which the support structure abuts the rim, wherein:

the support structure has an outermost edge shaped to correspond with the three-dimensional shape of the rim of the toilet bowl and a flat seat portion surrounding an opening in the support structure;

the frontal extension is elongated in the forward direction from the rearward portion;

the rearward portion has a width of at least 400 mm in a transverse direction, the transverse direction being perpendicular to the forward direction;

the frontal extension has a length of at least 290 mm in the forward direction;

the width of the frontal extension in the transverse direction does not exceed 200 mm in a forwardmost 190 mm of the frontal extension;

the outermost edge extends around all of the support structure except for the section of the support structure attached to the toilet bowl with the hinge assembly, a full length of the outermost edge contacting the rim or adjacent the hinge assembly in the closed position; and the support structure is configured such that at least part of the seat portion is at least 110 mm from the rim.

24. The toilet bowl of claim 23, comprising a flat edge or surface configured to contact a wall, wherein:

the flat edge or surface defines a plane, the forward direction is perpendicular to the plane, and the transverse direction lies in the plane.

25. The toilet bowl of claim 23, wherein when in use in a configuration that the floor is flat, the forward and transverse directions are parallel to the floor.

26. The toilet of claim 23, wherein the support structure is configured such that at least part of the seat portion is at least 120 mm from the rim.

27. The toilet of claim 23, wherein the support structure has a maximum height of less than 200 mm.

28. The toilet of claim 23, wherein the support structure has a maximum height of less than 170 mm.

* * * * *